US005162854A

United States Patent [19]

Hilbert et al.

[11] Patent Number: 5,162,854

[45] Date of Patent: Nov. 10, 1992

[54] IMAGE FORMING APPARATUS HAVING AT LEAST TWO TONING STATIONS

[75] Inventors: Thomas K. Hilbert, Spencerport; Kevin M. Johnson; James R. Carey, both of Rochester, all of N.Y.

[73] Assignee: Eastman Kodak Company, Rochester, N.Y.

[21] Appl. No.: 711,839

[22] Filed: Jun. 7, 1991

[51] Int. Cl.[5] ..... G03G 15/01

[52] U.S. Cl. ..... 355/245; 355/326; 118/645

[58] Field of Search ..... 355/245, 251, 326, 327; 118/645, 653, 657-658

[56] References Cited

U.S. PATENT DOCUMENTS

| | | | |
|---|---|---|---|
| 4,466,729 | 8/1984 | Iwata . | |
| 4,473,029 | 9/1984 | Fritz et al. . | |
| 4,531,832 | 7/1985 | Kroll et al. . | |
| 4,546,060 | 10/1985 | Miskinis et al. . | |
| 4,627,701 | 12/1986 | Onoda et al. . | |
| 4,671,207 | 6/1987 | Hilbert . | |
| 4,699,495 | 10/1987 | Hilbert . | |
| 4,716,437 | 12/1987 | MacLellan . | |
| 4,746,951 | 5/1988 | Hayakawa et al. | 355/245 |
| 4,746,954 | 5/1988 | Matuura et al. | 355/251 |
| 4,748,471 | 5/1988 | Adkins . | |
| 4,956,674 | 9/1990 | Kalyandurg . | |
| 4,956,675 | 9/1990 | Joseph | 355/251 |
| 4,970,561 | 11/1990 | Mizuno | 355/326 |

FOREIGN PATENT DOCUMENTS

| | | | |
|---|---|---|---|
| 403314A | 12/1990 | European Pat. Off. . | |
| 58-187965 | 11/1983 | Japan | 355/245 |
| 2-153371 | 6/1990 | Japan | 355/245 |
| 2-262683 | 10/1990 | Japan . | |

OTHER PUBLICATIONS

U.S. patent application Ser. No. 07/451,853, filed Dec. 18, 1989, Hilbert.

U.S. patent application Ser. No. 07/621,686, filed Dec. 3, 1990, DeCecca et al.

*Primary Examiner*—Joan H. Pendegrass

*Attorney, Agent, or Firm*—Leonard W. Treash, Jr.

[57] ABSTRACT

An image-forming apparatus particularly usable in making multicolor toner images includes toning stations in pairs. First and second toning stations each have a toner applicator. A spacing roller or disk is mounted at each end of each applicator. Because the toning unit includes two stations and two applicators, the four disks can be used to accurately position the applicators with respect to an image surface such as a photoconductive drum.

19 Claims, 6 Drawing Sheets

10
7
281
81
8
282
82
47
46
40
41
42
241
245
246
243
244
252
259
242
253
247
249
248
251

40

IMAGE FORMING APPARATUS HAVING AT LEAST TWO TONING STATIONS

RELATED APPLICATIONS

This application is related to co-assigned:

U.S. Pat. application Ser. No. 07/712,227, filed Jun. 7, 1991, TONING STATION FOR SELECTIVELY APPLYING TONER TO AN ELECTROSTATIC IMAGE, in the name of Westbrook et al.

U.S. Pat. application Ser. No. 07/712,225, filed Jun. 7, 1991, TONING STATION DRIVE FOR IMAGE-FORMING APPARATUS, in the name of Hilbert et al.

U.S. Pat. application Ser. No. 07/712,022, filed Jun. 7, 1991, IMAGE FORMING APPARATUS HAVING A MAGNETIC BRUSH TONING STATION, in the name of Hilbert et al.

1. Technical Field

This invention relates to the development of electrostatic images by the application of toner. It is particularly usable in multicolor electrophotographic image forming apparatus, although it can be used in other apparatus in which electrostatic images are developed.

More specifically, this invention relates to the mounting of at least two toning stations with respect to an image/carrying surface, such as a photoconductive drum. It also relates to a two toning station unit for developing electrostatic images.

2. Background Art

U.S. Pat. application Ser. No. 621,686, filed to DeCecca et al, Dec. 3, 1990, discloses a series of four development or toning stations which are sequentially moved into position with respect to an electrostatic image carrying drum. Each toning station includes an applicator having a surface across which developer moves to develop electrostatic images carried by the drum. It is important in this and other similar types of toning apparatus that the applicator be spaced a small but accurate distance from the surface carrying the electrostatic image.

That application shows several design approaches to providing an accurate spacing between the applicator and the drum. One approach includes the provision of four rollers, two on each end, one on each side of the applicator. The four rollers engage the drum and accurately space the applicator. If the rollers are accurately positioned with respect to the applicator, the axis of the applicator can be maintained parallel to the axis of the drum despite inaccuracy in the mechanism that positions the station as a whole. A second approach shown in that application includes a disk at each end of and coaxial with the applicator. Each disk contacts a pair of rollers accurately positioned with respect to the drum's surface. With this structure, the applicator and disk are much easier to accurately manufacture than the four roller approach, but the receiving structure is somewhat more complicated.

A similar four-roller approach has been used to position other components in electrophotographic apparatus. For example, it has been used to accurately position charging stations with respect to photoconductive drums. See, for example, Japanese Kokai 53-81130 (1978) and U.S. Pat. No. 4,466,729. See also, U.S. Pat. No. 4,627,701 showing a single roller at each end of a charging device.

Use of a single roller or disk at each end of an applicator would be far superior from a manufacturing standpoint to the provision of a pair of rollers at each end, neither of which are coaxial with the applicator. Unfortunately, a single roller or disk at opposite ends of an applicator will provide accurate spacing for the applicator only if the axis of the disks and applicator is parallel with the axis of the drum. To provide this parallelism requires other mounting structure.

U.S. Pat. No. 4,970,561, Mizuno, issued Nov. 13, 1990, shows an image-forming apparatus with a pair of development stations arranged around a photoconductive drum. Typical of many multicolor electrophotographic apparatus, this device provides a mechanism for moving each of the toning stations into a toning position when the other is not in its toning position. This structure allows selective toning of an electrostatic image with one of two colors. It can be used to give the customer a choice of colors for an image or it can be used to provide the customer with multicolor images. In the latter case, the color images are superposed either by transferring toner images in registration from different frames or by forming the toner images one after another on the same frame.

U.S. Pat. No. 4,748,471 to Adkins, issued May 31, 1988, is one of a number of references which suggest that selectivity between toning stations can be provided without movement of the station toward and away from the image-bearing surface. In this reference a gate or valve is used to shut off transport of developer from a mixing portion of the station to the applicator when the station is not intended to tone an image passing the applicator. This structure has the substantial advantage of not requiring movement of the entire station between colors. See also U.S. Pat. Nos. 4,671,207, T. K. Hilbert, issued Jun. 9, 1987; 4,699,495, T. K. Hilbert, issued Oct. 13, 1987; 4,956,675, Joseph, issued Sep. 11, 1990.

DISCLOSURE OF THE INVENTION

It is an object of the invention to provide an image-forming apparatus having at least two development or toning stations in which the means for positioning the toning stations with respect to an image member is both accurate and simple in construction.

This and other objects are accomplished by an image-forming apparatus which has an image member having an image surface, for example, a cylindrical image surface, and means for forming electrostatic images on the image surface. First and second toning stations for applying toner to an electrostatic image on the image surface are fixed with respect to each other to form a toning unit. Each station has an elongated applicator having an axis, for example, an axis of rotation about which a component rotates. The axes of the applicators are accurately positioned with respect to each other, preferably parallel to each other. Each applicator has a spacing means associated with each end, preferably, a disk or roller coaxial with the applicator. The spacing means contacts the image member or comparable positioning surfaces associated with the image surface. The toning unit is urged toward the image member to cause all four of the spacing means to contact the positioning surfaces to accurately position the applicators with respect to the image surface.

This invention provides the stability and accurate positioning of a four-roller system but with the simplicity associated with rollers or disks that are positioned coaxially with respect to the applicators.

Because the invention uses two toning stations with their applicators simultaneously positioned in toning relation to the image surface, it has particular application to multicolor devices in which toning is controlled without separate movement of the entire station.

BEST MODE OF CARRYING OUT THE INVENTION

Figure 1:
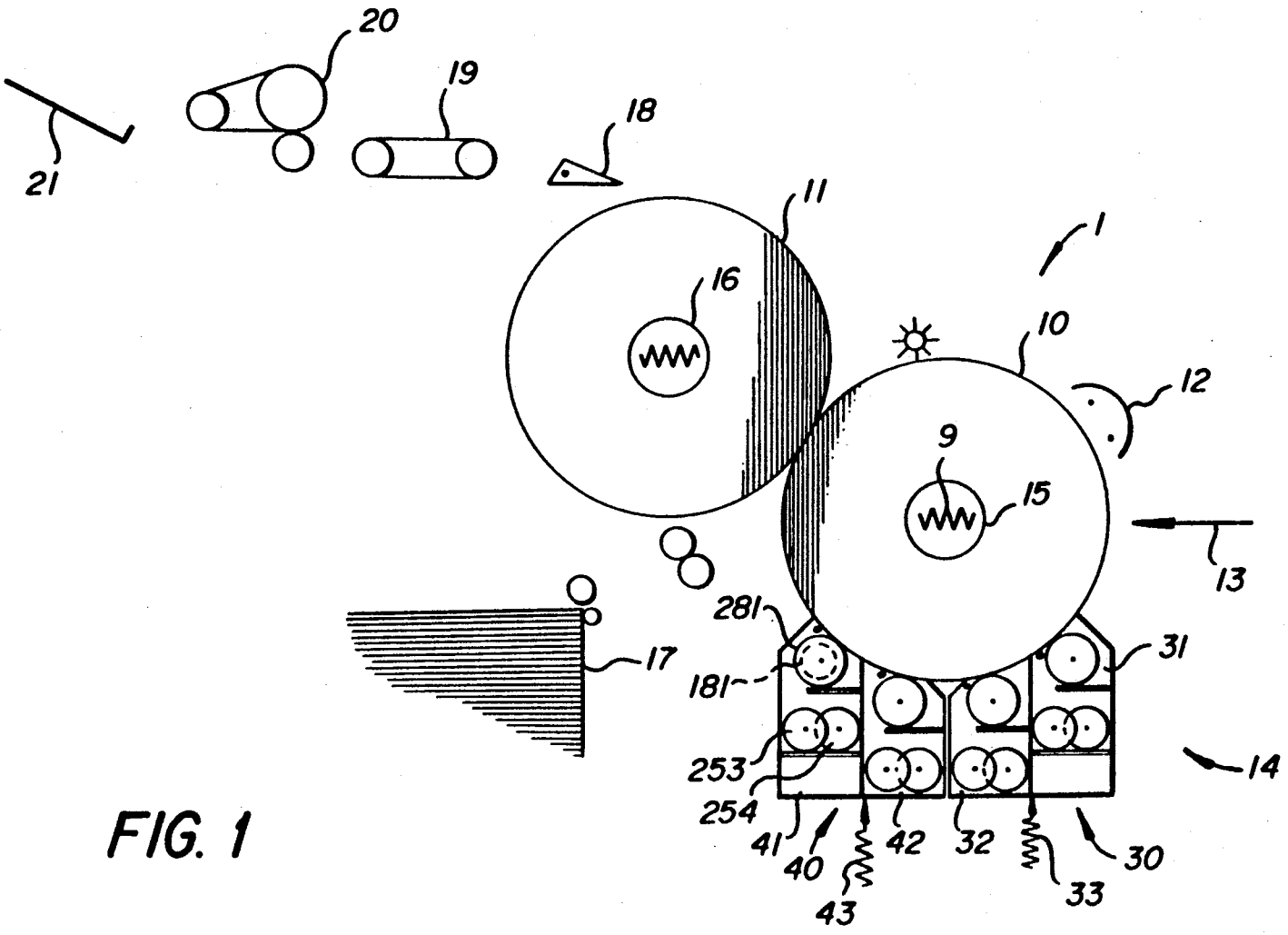
FIG. 1 is a front schematic of a multicolor image-forming apparatus with the insides of certain components shown schematically.

The invention is particularly usable in a multicolor image-forming apparatus similar to that shown in FIG. 1. According to FIG. 1, a multicolor image-forming apparatus 1 includes an image member 10 which can be a metallic drum having appropriate photoconductive and other layers for forming electrostatic images, all as is well known in the art. Image member 10 could also be a photoconductive or dielectric web wrapped entirely or partially around a cylindrical drum. The image member 10 defines an image surface on which electrostatic images are formed.

Drum-shaped image member 10 is rotated by means not shown past a series of stations which include a charging station 12, which applies a uniform charge to the image surface. The charged image surface is exposed by an exposure station, for example, a laser exposure station 13 to create a series of electrostatic images. Those images are toned by a cluster 14 of toning stations. Cluster 14 contains four stations 31, 32, 41 and 42, each of which contain a different color toner. Each electrostatic image is toned by one of said stations to create a single color toner image. A series of images can be toned by different stations to create a series of different color toner images.

Each different color toner image is transferred to a receiving sheet carried by a transfer drum 11 and fed from a receiving sheet supply 17. The receiving sheet is held to transfer drum 11 by conventional means, for example, vacuum holes, holding fingers or electrostatics, not shown. To form multicolor images, each of the single color images of a series is superposed in registration on the receiving sheet as transfer drum 11 repeatedly rotates the receiving sheet through a nip with image member 10.

Conventionally, transfer would be accomplished by an electrostatic field. However, for highest quality work, transfer drum 11 is heated by an internal heat source 16 sufficiently to sinter toner in the toner image. Sintered toner has a tendency to stick to the receiving sheet, thereby transferring. This process can be assisted by a moderate heating of image member 10 using a lamp 15. It can also be assisted using a receiving sheet with a heat softenable outer layer, which layer is softened by the temperature of drum 11 and which contacts the toner image.

After the desired number of images are transferred in registration to the receiving sheet, it is separated from drum 11 by a separating pawl 18 which moves into engagement with drum 11 for this purpose. The receiving sheet is transported by a conventional transport means 19 to a fixing device 20 and then to an output tray 21.

Cluster 14 includes four toning or development stations divided into two toning units 30 and 40. Unit 30 includes stations 31 and 32, while unit 40 includes stations 41 and 42. The cluster 14 is symmetrical about a plane between stations 32 and 42, which plane contains an axis of rotation 9 of image member 10. Each of the units 30 and 40 are not symmetrical themselves, as is evident from FIG. 1. However, they are mirror images of each other and, thus, can be built with the same housing parts.

Each of units 30 and 40 is separately mountable in apparatus 1 as a unit. Each unit is loaded in the apparatus by moving it in a direction generally parallel to axis 9 to a position below its position shown in FIG. 1. The unit is then raised by a lifting mechanism, shown in FIG. 4, into operative position with respect to image member 10 where the lifting mechanism resiliently urges it into a position controlled by appropriate spacing means to be described with respect to FIG. 4.

Figure 3:
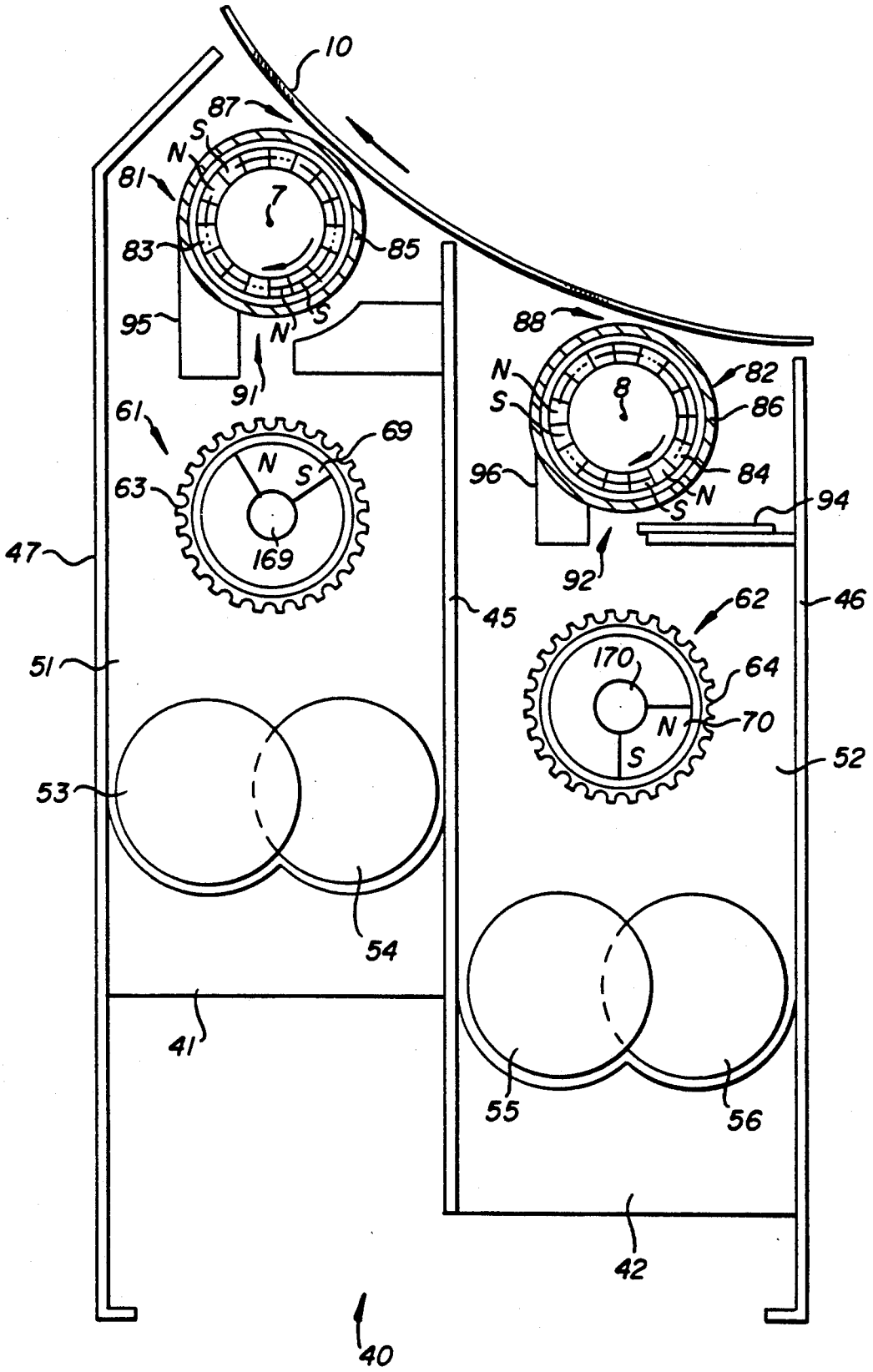
FIG. 3 is a side section of a toning unit usable in the apparatus shown in FIG. 1 and illustrating the developer handling function of the unit.

The inner workings of the toning stations are somewhat different between the embodiments shown in FIGS. 1 and 3. Referring first to the embodiment shown in FIG. 3, toning unit 40 includes a first toning station 41 and a second toning station 42. Toning unit 40 is of a single unitary construction defining development chambers 51 and 52 for both stations. Thus, stations 41 and 42 have a common center wall 45 and external side walls 46 and 47. Unitary end walls, not shown, can further define both stations.

Within each of development chambers 51 and 52 are mounted a pair of mixing devices, for example, paddle mixers 53 and 54 and 55 and 56, respectively, which can be constructed according to the teachings of U.S. Pat. No. 5,025,287 issued Jun. 18, 1991, in the name of T. K. Hilbert. Mixing devices 53–56 are in the bottom of developer sumps forming the bottom of chambers 51 and 52. They are rotated rapidly to thoroughly mix a two-component developer and raise the level of the developer until it comes under the influence of developer transport devices 61 and 62 in each station.

Developer transport devices 61 and 62 include rotatable transport rollers 63 and 64, respectively, each of which have an outer fluted surface for transporting developer.

At the top of stations 41 and 42 are applicators 81 and 82, respectively. Each applicator includes a rotatable magnetic core 83 and 84 and a nonmagnetic sleeve 85 and 86. As seen in FIG. 3, magnetic cores 83 and 84 are rotatable in a clockwise direction which causes developer having a magnetic component to move in a counterclockwise direction around sleeves 85 and 86. This type of applicator can be used with single-component magnetic developer or conventional two-component developer having a magnetic carrier. However, it is preferably used with a two component developer having hard magnetic carrier and a nonmagnetic toner such as that described in U.S. Pat. Nos. 4,546,060, Miskinis et al, issued Oct. 8, 1985; 4,473,029, Fritz et al, issued Sep. 25, 1984; and 4,531,832, Kroll et al, issued Jul. 30, 1985. With such developer, rapid rotation of cores 83 and 84 causes the developer to move around sleeves 85 and 86 in a direction opposite to the direction of rotation of the core, bringing the developer through development or toning positions 87 and 88 between sleeves 85 and 86 and the image surface of image member 10. Flow of developer around sleeves 85 and 86 can also be affected by rotation of sleeves 85 and 86 in either direction, as is well known in the art. In the FIG. 3 embodiment the sleeves do not rotate and the entire movement of the developer is driven by cores 83 and 84. In the FIG. 6 embodiment, the sleeve is rotated with the flow of developer.

Flow of developer from the bottom or sump portion of chambers 51 and 52 is controlled by several means. Developer above mixers 53–56 is attracted to transport rollers 63 and 64 by magnetic gates 69 and 70. As shown with respect to station 42, developer above mixers 55 and 56 is attracted into contact with roller 64 by magnetic gate 70. Rotation of roller 64 brings the developer held by gate 70 up to the top of transport device 62 where it is attracted by core 84 in applicator 82. With magnetic gate 70 in the position shown with respect to toning station 42, station 42 is applying developer to an electrostatic image passing through toning position 88 on the image surface of image member 10.

As shown with respect to station 41, magnetic gate 69 has been rotated until it is facing applicator 81. In this position no developer is attracted to the transport roller 63, and developer is inhibited from leaving the top of transport device 61, thereby shutting off the supply of developer to applicator 81 to prevent toning by toning station 41 of an electrostatic image passing through development position 87. This structure, merely by the rotation of magnetic gate 69, controls whether or not station 41 applies toner to a passing electrostatic image. The stations do not need to be moved into and out of toning position between images.

Developer leaving transport roller 64 passes through an opening 92 associated with applicator 82 which assists in metering the amount of toner moved by applicator 82. As shown with respect to toning station 42, opening 92 can be given a factory or field adjustment in size by moving a sliding plate 94. With respect to toning station 41, the comparable opening 91 is shown permanently formed. Obviously, in commercial use both stations would have the same structure. They are shown different in FIG. 3 only to illustrate some of the variations possible.

Developer leaving developing positions 87 and 88 is separated from sleeves 85 and 86 by skives 95 and 96. As seen with respect to toning station 41, skive 95 and opening 91 can be defined by substantially the same element positioned and attached to center wall 45.

The above described developer gating system is an improvement of apparatus shown and described in U.S. Pat. No. 4,748,471, cited above, the disclosure of which is incorporated by reference herein. See also, U.S. Pat. Nos. 4,956,674 and 4,716,437.

Figure 6:
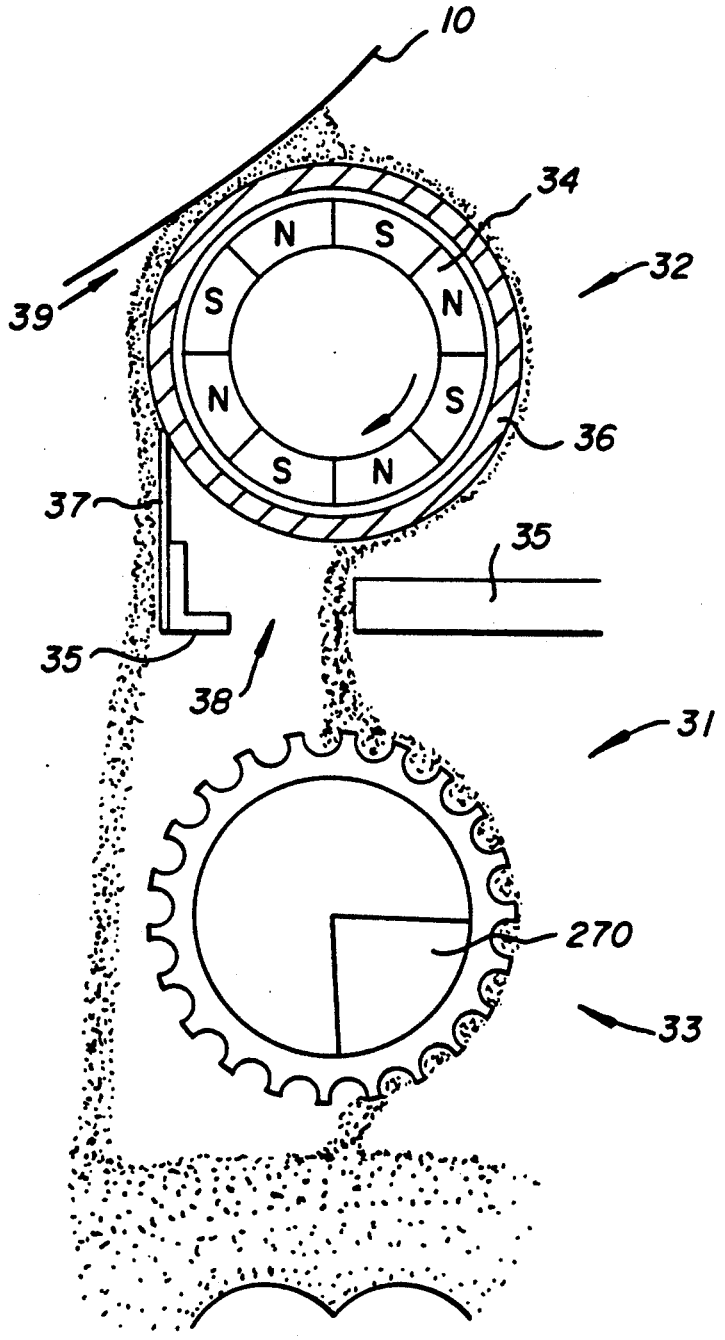
FIG. 6 is a schematic side section similar to FIG. 3 illustrating, with respect to a different one of the toning stations, the operation of a skive or wiper preferably employed in all toning stations.

FIG. 6 best illustrates another aspect interior to each of the toning stations in cluster 14. For reasons which will become apparent, this is illustrated with respect to station 31. According to FIG. 6, developer in station 31 is transported by a transporter 33 controlled by a gate 270 into the magnetic field of a rotating magnetic core 34 in the same manner as described with respect to stations 41 and 42 and shown in FIG. 3. Developer is attracted by core 34 through an opening 38 and into contact with a sleeve 36. Unlike the FIG. 3 embodiment, in the FIG. 6 embodiment the sleeve is rotatable in a counterclockwise direction which supplements the effect of the clockwise rotation of core 34 on the hard carrier particles in the developer.

However, as in the FIG. 3 embodiment, the developer is moved primarily by the rotation of core 34 from an upstream position adjacent or opposite opening 38 through a toning position 39. As described in U.S. Pat. No. 4,546,060, Miskinis et al, the rapid rotation of the core causes a rapid tumbling of the carrier because of the carrier's high coercivity. The outside surface of sleeve 36 can be somewhat roughened. The tumbling of the carrier aided by the roughened surface causes the developer to move relative to the roughened surface. The tumbling of the carrier also greatly enhances the development of the image in the toning position 39, as explained in the Miskinis et al patent.

After the developer leaves the toning position 39 between sleeve 36 and image member 10, it is starved of toner and is recirculated to the body of developer below transport 33 for remixing as described with respect to FIG. 3. To remove developer from sleeve 36 it is skived by a blade shaped skive or wiper 37, spring urged against sleeve 36 at a position downstream from toning position 39. Skive 37 is held by a support 35 which can also define opening 38.

This structure is designed for high quality color imaging, for example, imaging with high resolution, small spherical color toners in the 3 to 5 micron size range. In using this structure with also small spherical hard magnetic carrier particles (for example, carrier particles in a size range between 20 and 40 microns), a problem with the traditional skive 37 developed. Spent, toner-starved developer accumulated around the point of contact between the skive 37 and the sleeve 36. Because of the orientation of station 31 (compared to the other stations), skive 37 is very close to image member 10. As starved developer backs up from skive 37 it interferes with the image leaving the toning position. Carrier in this area has a tendency to be carried away by image member 10 creating well known problems downstream. Moreover, starved carrier buildup reduces the density of the image. Of most importance, the buildup has a tendency to remain after the station has been turned off. The buildup then may inadvertently apply toner of the wrong color to an image to be toned by a downstream station.

To increase developer flow along the blade or skive 37, a size 400 grit is applied to the left surface of the skive 37. This roughens the surface which causes the carrier particles which are still tumbling under the influence of core 34 to tumble down the skive and away from image member 10. This aspect is illustrated in FIG. 6 with respect to station 31 in which the skive is closest to image member 10. However, the skives shown in FIG. 3 are also roughened to facilitate flow of developer as in station 31. Although the roughened skive 37 is shown with respect to a counterclockwise moving sleeve 36, it is also usable with a clockwise moving sleeve and a stationary sleeve. The latter is shown in FIG. 3.

Figure 2:
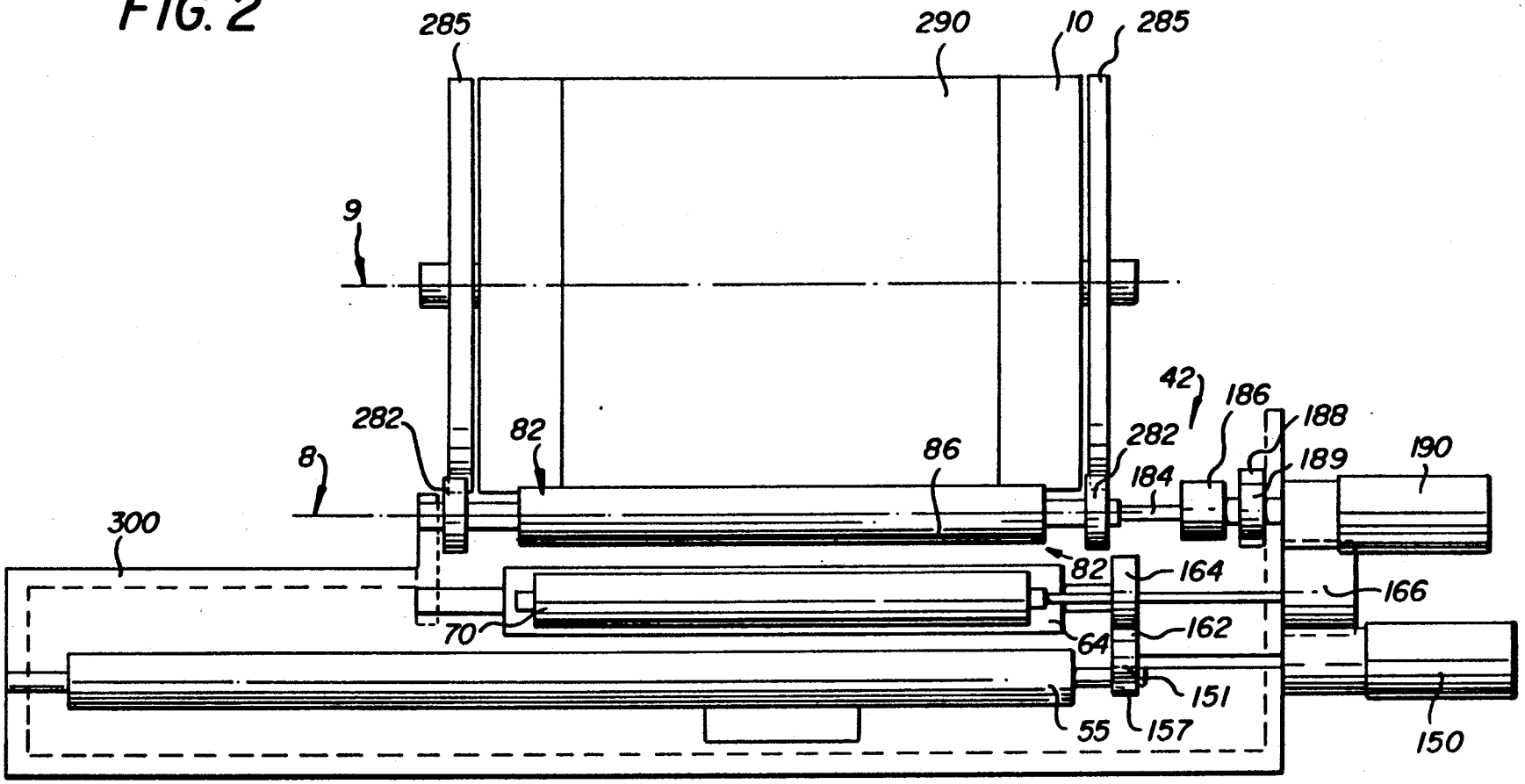
FIG. 2 is a side schematic of a portion of the apparatus shown in FIG. 1 with a portion of a single toning station shown with many parts not shown for clarity of illustration.
Figure 5:
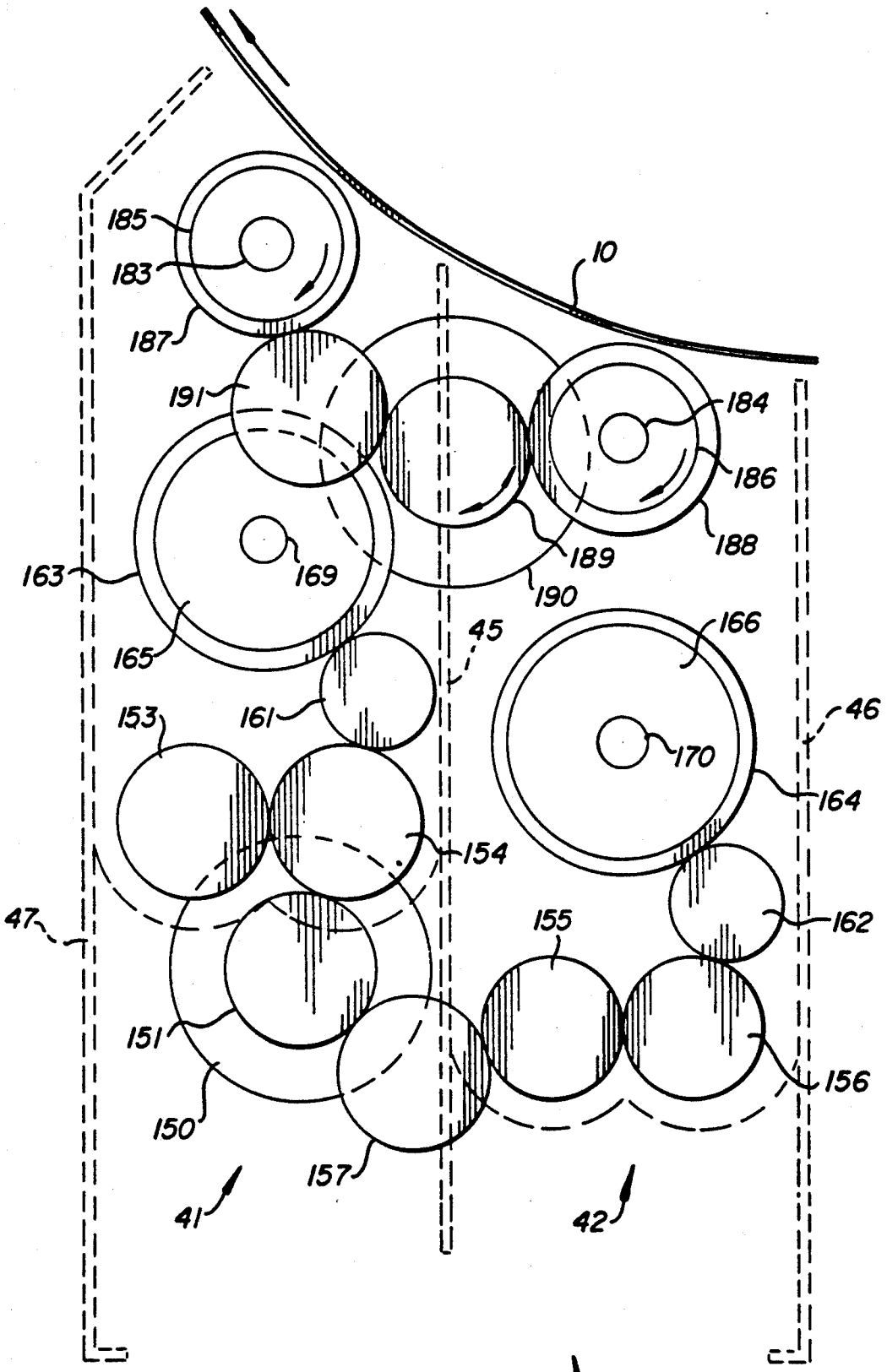
FIG. 5 is a gearing schematic of the toning unit shown in FIGS. 3 and 4 illustrating its drive mechanism.

FIG. 5 is a schematic illustrating the drive and control elements for the components described with respect to FIG. 3. The drive and control elements for station 42 are also shown in FIG. 2. Rotatable cores 83 and 84, shown in FIG. 3, are driven by shafts 183 and 184 shown in FIG. 5. Shaft 183 is driven through a one-way clutch 185 by a driven gear 187. Similarly, and as shown in both FIGS. 2 and 5, shaft 184 is driven through a one-way clutch 186 by a driven gear 188. Driven gear 188 is directly engaged by a drive gear 189 which, in turn, is driven by a reversible motor 190. Driven gear 187 is driven by idler gear 191 which, in turn, is also driven by drive gear 189 and reversible motor 190.

Preferably, developer is moved around sleeves 85 and 86 in a counterclockwise direction so that it is moving in the same direction as the electrostatic image it is toning at the toning positions 87 and 88. One-way clutches 185 and 186 permit rotation of shafts 184 and 185 only in a clockwise direction. Thus, when motor 190 drives drive gear 189 in a counterclockwise direction, it rotates driven gear 188 in a clockwise direction, driving shaft 184 and core 84 through one-way clutch 186, also in a clockwise direction to drive developer through development position 88. During this motion, gear 187 is driven in a counterclockwise direction. Because of one-way clutch 185, shaft 183 and core 83 are not driven at this time.

When motor 190 is reversed, it rotates drive gear 189 in a clockwise direction to, in turn, rotate idler gear 191 in a counterclockwise direction. Idler gear 191 drives driven gear 187 in a clockwise direction to drive shaft 183 and core 83 in a clockwise direction through one-way clutch 185. During this motion, gear 188 is driven in a counterclockwise direction but, because of one-way clutch 186, does not drive shaft 184 or core 84 at all.

Thus, a single motor 190 is able to selectively drive either core 83 or core 84 in its appropriate direction according to the direction that motor 190 is driven. If neither station 41 nor station 42 is to tone at a particular time, for example, while an image is passing that has been toned by one of stations 31 or 32, motor 190 is off.

Mixers 53, 54, 55 and 56 (FIG. 3) are all driven by a single motor 150 (FIGS. 2 and 5) through a drive gear 151 which directly drives driven gears 153 and 154 connected to mixers 53 and 54 and drives driven gears 155 and 156 through an idler 157. The same one-way clutch and reversible motor system applied to the applicators 81 and 82 could be also applied to mixing devices 53, 54, 55 and 56. However, it is preferable to continue mixing as long as the image forming apparatus is being used to assure continual charging and uniform mixing of the developer. Therefore, motor 150 is continuously driven, and no one-way clutches are used in driving the mixers in the FIG. 3 apparatus.

Transport rollers 63 and 64 are also continuously driven by motor 150 through driven gears 163 and 164 and idlers 161 and 162 which engage driven gears 154 and 156, respectively.

Movement of magnetic gates 69 and 70 between their positions shown with respect to stations 41 and 42 in FIG. 3 is accomplished by a pair of rotary solenoids 165 and 166 through shafts 169 and 170 that are common both to the solenoids and gates 69 and 70, respectively.

Figure 4:
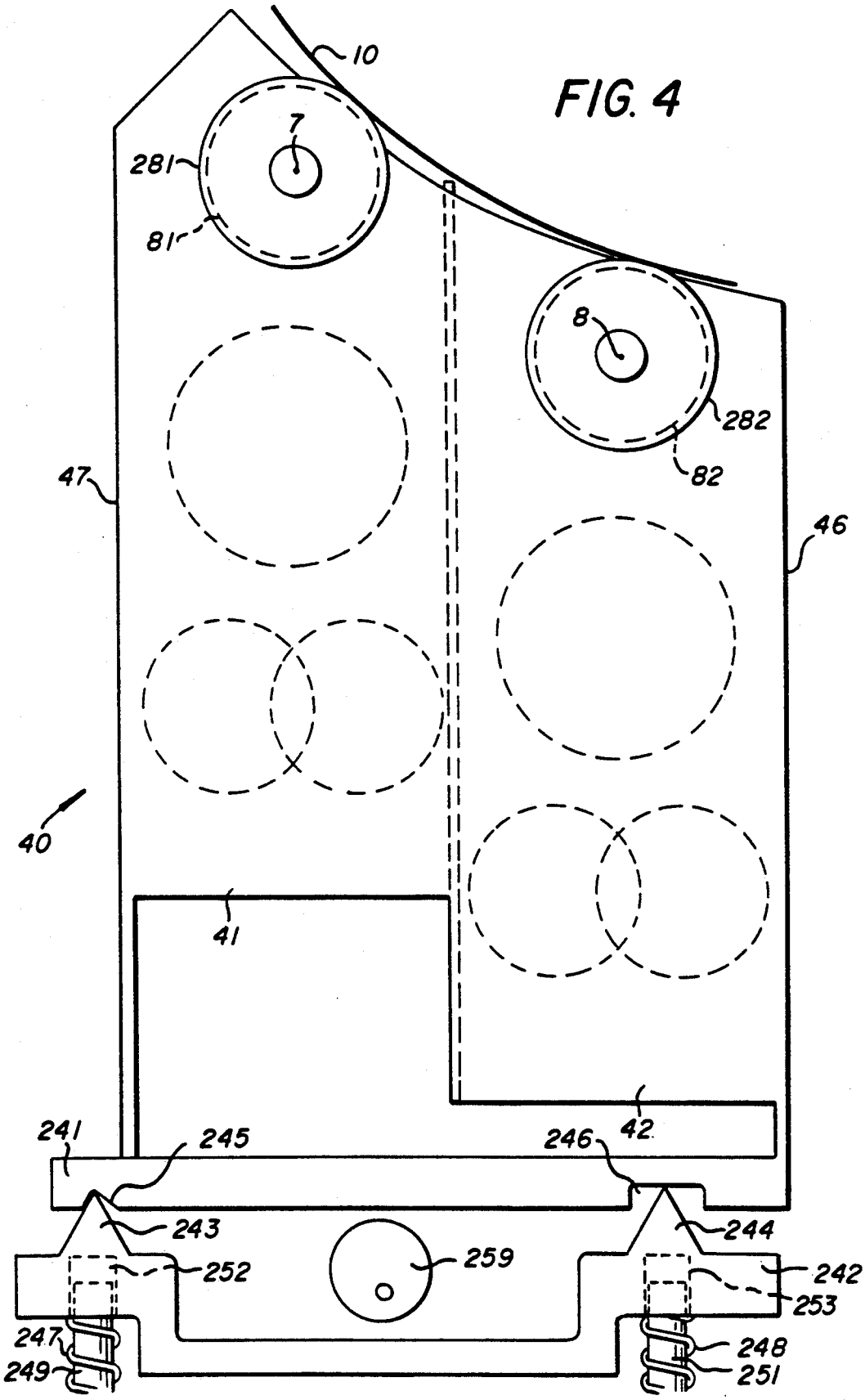
FIG. 4 is a side view partly in section of the unit shown in FIG. 3 and illustrating the positioning components of the unit.

FIG. 4 illustrates the advantage of toning unit 40 in accurately positioning stations 41 and 42 with respect to image member 10. According to FIG. 4, disks 281 and 282 are mounted concentrically with axes 7 and 8 of applicators 81 and 82. Identical disks are also mounted at the opposite ends of the applicators. Disks 281 and 282 are sized to have a radius measured from axes 7 and 8 equal to the outside radius of shells 85 and 86 plus the desired spacing between shells 85 and 86 and the image surface of image member 10.

If axes 7 and 8 are parallel to each other in toning unit 40 and toning unit 40 is pushed generally in an upward direction by a lifting device, as illustrated schematically by urging means 43 in FIG. 1, and the orientation of walls 46 and 47 is not restricted, then all four disks 281 and 282 will engage image member 10, and the axes 7 and 8 will be parallel to the axis 9 of image member 10. If the axes 7 and 8 are parallel to the axis 9 and the disks 281 and 282 are the same size, then the spacings between applicators 81 and 82 and the image surface will be the desired amount and will be constant across the image surface.

The orientation of walls 46 and 47 is determined by the vertical spacing between axes 7 and 8. This vertical spacing between axes 7 and 8 is chosen in FIG. 1 to cause walls 46 and 47 to also be vertical and parallel to the comparable walls on toning unit 30. This allows the four stations to be positioned generally parallel to each other as shown in FIG. 1. This vertical distance between axes 7 and 8 is not a critical dimension and can be accomplished with relatively less demanding tolerances providing the directional relation of the axes is maintained.

The preferred lifting mechanism for moving the toning unit 40 vertically upward until disks 281 and 282 engage image member 10 is shown in FIG. 4. According to FIG. 4, a bottom member 241 is positioned at each end of unit 40. A caming shoe 242 has protrusions 243 and 244 which engage indentations 245 and 246 in member 241. Indentation 246 is broad laterally so that the lateral position of unit 40 is determined by indentation 245. Lift springs 247 and 248 around guide pins 249 and 251 urge caming shoe 242 upward with respect to pins 249 and 251 which pins slide in holes 252 and 253 in shoe 242.

A control cam 259, shown in an inactive position with the unit 40 in an up position can be rotated to lower shoe 242 which permits unit 40 to move downward away from image member 10 under force of gravity. Alternatively, shoe 245 and member 241 can be spring urged together to actively force unit 40 to follow shoe 242.

Note that protrusions 243 and 244 are laterally outside of the contact points between disks 281 and 282 and the positioning surfaces, and each protrusion is being urged by its own spring 247 or 248 which is aligned with it. This arrangement assures contact of each of the four disks with the positioning surfaces, assuring proper spacing of the applicators.

FIG. 4 shows disks 281 and 282 riding on a portion of the image member 10 outside the portion used for imaging which portion becomes a positioning surface for disks 281 and 282. With such a structure, disks 281 and 282 are rollers which rotate on the positioning surface as it moves with the image member. However, a preferred form of this portion of the apparatus is better seen in FIG. 2. In FIG. 2, station 41 is broken away showing the inside of station 42 with many parts eliminated for clarity. In this embodiment, disks 282 are not rotatable and rest on an also not rotatable pair of large disks 285 at opposite ends of image member 10. Large disks 285 are each machined to have a cylindrical positioning surface coaxial with image member 10 and having the same diameter as the image surface of image member 10. Large disks 285 do not rotate with image member 10 and, thus, disks 282 do not have to rotate. Disks 285 are made to be full cylinders so that other stations can be positioned using their positioning surfaces. However, for positioning the toning stations alone they do not have to be full cylinders.

Similarly, disks 281 and 282 do not have to be cylindrical since they do not rotate. According to a preferred embodiment they are elliptical or eccentrically mounted and rotationally adjustable to allow a factory or field adjustment of the spacing between the applicator and the image surface. For example, the spacing between the image surface and the applicators can be adjusted between 0.010 and 0.020 inches with an appropriately shaped elliptical disk.

Referring again to FIG. 4, note that the unity of toning stations 41 and 42 in the toning unit 40 allows the use of a much simpler positioning device in disks or rollers 281 and 282 than is possible in structures in which two stations are not combined into a single unitary unit, for example, structure in which four rollers are positioned to the sides of each applicator. Because the rollers have to be positioned accurately with respect to the applicator in such multiroller devices, the structure shown in FIGS. 4 and 1 is much easier with which to maintain tolerances. Thus, not only is this approach to positioning unit 40 far more simple, it is also more accurate when produced in quantity.

For ease in maintaining tolerances, disks or rollers 281 and 282 are preferably coaxial with applicators 81 and 82, although they could be mounted on another axis having a fixed spacial relation with the surface of the applicator in toning positions 87 and 88. Further, if cores 83 and 84 have different axes from sleeves 85 and 86 (a known construction), it is preferable (although not necessary) that disks or rollers 281 and 282 be mounted coaxial with sleeves 85 and 86 for highest accuracy.

The toning unit 30 is mounted in exactly the same manner as the toning unit 40 except that the parts are a mirror image of those in the toning unit 40. As mentioned above, this allows essentially the same parts to be used for both toning units.

Although the structure illustrated in FIG. 4 is most useful in providing an accurate and constant gap or spacing between an applicator and an image surface, it can also be used in known development devices in which the applicator contacts the image surface. In this instance, parallel axes are also important and the rollers or disks can control the amount of such contact.

FIG. 2 also illustrates another embodiment of the FIG. 1 apparatus. According to FIG. 2, the image surface is, in fact, the outer surface of a web 290 which has been stretched around the outside cylindrical surface of image member 10 to provide a cylindrical or drum-shaped image surface. Note also in FIG. 2 that unit 42 has a portion 300 extending well beyond the end of image member 10. This extended portion contains the mixers 55 and 56 and can receive toner from toner bottles mounted above it.

FIG. 1 also illustrates an interior modification of the toning stations. According to FIG. 1, transport devices 62 and 63 are eliminated, and paddle mixing devices 253 and 254 are directly below an applicator 181. The flow of developer is shut off in this embodiment by stopping the rotation of mixing devices 253 and 254 which lowers the level of developer in the development chamber to a position at which it is no longer attractive to the magnetic core of applicator 181. This approach to terminating the flow of developer provides a more simple construction than that shown in FIGS. 3–6. However, it is not as quick in gating the developer flow. For that reason, the structure shown in FIGS. 3–6 is preferred for high speed imaging.

Although the toning stations herein are described with respect to a multicolor image-forming apparatus in which each frame contains a different color toner image and in which formation of the multicolor image is by registration of the toner images at transfer, aspects of this structure can be used in any other apparatus in which two toning stations are used. For example, it is known to sequentially form and tone electrostatic images on the same frame using different color toners. In this instance, the image member needs to have a circumference equal to at least the size of a frame, and each electrostatic image is formed on a different revolution of the drum using a laser or other exposing means. The toning means for such a system can be substantially as described herein, and all aspects of the invention would be advantageous in such an application.

The invention has been described in detail with particular reference to a preferred embodiment thereof, but it will be understood that variations and modifications can be effected within the spirit and scope of the invention as described hereinabove and as defined in the appended claims.

We claim:

1. An image-forming apparatus comprising:

an image member having opposite ends, a cylindrical image surface and an axis of rotation about which said image surface is rotatable, means for forming electrostatic images on said image surface, means associated with said image member defining two positioning surfaces which positioning surfaces have a fixed positional relationship with respect to the image surface and which positional surfaces are located generally at or beyond opposite ends of said image surface, first and second toning stations for applying toner to said electrostatic image, each of said toning stations including, an elongated applicator having opposite ends, a longitudinal axis and a toner bearing surface having a desired positional relationship with the image surface, spacing means mounted generally at each end of said applicator and positioned and sized to contact said positioning surfaces, to provide the desired positional relationship of said applicator and said image surface, said toning stations being fixed with respect to each other to form a first toning unit, with the axes of rotation of the applicators being parallel to each other, and means for urging said first toning unit toward said image member to cause all four of said toner spacing means, and only said four toner spacing means, to contact said positioning surfaces to accurately position the applicators with respect to said image surface.

2. The image-forming apparatus according to claim 1 wherein each of said spacing means are disk or roller shaped and are mounted coaxially with its applicator and the axes of the applicators are parallel.

3. The apparatus according to claim 1 wherein said means defining said positioning surfaces are a pair of disks coaxially mounted with respect to said image member but not rotatable with said image member.

4. Image-forming apparatus according to claim 1 wherein said means defining said positioning surface is integral with said image member and rotates with said image member, and further wherein each of said spacing means are rotatable rollers mounted coaxially with its applicator.

5. Image-forming apparatus according to claim 1 further including third and fourth toning stations forming a second toning unit, which second toning unit is a mirror image of the first toning unit and is positioned generally alongside said first toning unit.

6. Image-forming apparatus according to claim 5 wherein said first and second units are each asymmetrical, but said two units together are symmetrical about a plane between the units, which plane passes through the axis of the image member.

7. Image-forming apparatus according to claim 6 wherein each of said stations includes mixing means located generally below its applicator, and sidewalls generally separating the stations which are parallel with each other and generally vertically oriented.

8. Image-forming apparatus according to claim 5 wherein each of said stations contains a toner of different color for providing a multicolor image.

9. Image-forming apparatus according to claim 5 wherein each of said stations includes means for preventing toning of an image without separating said spacing means from said positioning surfaces.

10. Image-forming apparatus according to claim 1 wherein each of said stations contains a toner of different color for providing a multicolor image.

11. Image-forming apparatus according to claim 1 wherein said first and second toning stations are integrally formed with a common wall between them.

12. Image-forming apparatus according to claim 1 wherein said spacing means are disks that are eccentrically mounted about the axis of their respective applicator and are rotatable to vary a separation between the applicator and the image surface.

13. Image-forming apparatus according to claim 1 wherein each of said toning stations includes means for preventing toning of an image without separating said spacing means from said positioning surfaces.

14. Apparatus according to claim 1 wherein each applicator includes a magnetic core rotatable about the axis of said applicator and a nonmagnetic sleeve surrounding said core having a surface across which developer having a least a magnetic component is driven by rotation of said core and wherein said sleeve is provided with a predetermined spacing from said image surface by said spacing means through which spacing developer is driven to tone an electrostatic image carried by said image surface.

15. An image-forming apparatus comprising:

a drum-shaped image member, having opposite ends, a cylindrical image surface associated with said drum and an axis of rotation, means defining a cylindrical positioning surface associated with each end of said imaging member and having a predetermined positional relationship with said image surface, means for forming a series of electrostatic images on said imaging surface, first, second, third and fourth toning stations for applying different color toners to said electrostatic images to form a series of different color toner images, each of said toning stations including, an elongated applicator having opposite ends, a longitudinal axis and a toner bearing surface having a desired positional relationship with said image surface, a pair of disk-shaped spacing means mounted coaxially with said applicator, one at each of its opposite ends for contacting said positioning surface, each spacing means being sized with respect to said applicator and said positioning surface to provide the desired positional relationship of said applicator and said image surface, said first and second toning stations being fixed together to form a first toning unit, with the axes of the applicators of said unit parallel with each other, said third and fourth stations being fixed with respect to each other to form a second toning unit, with the axes of the applicators of said second unit parallel with each other, and means for urging said first and second toning units toward said image member to cause all eight of said spacing means to contact said positioning surfaces to accurately position the applicators with respect to said image surface.

16. Image-forming apparatus according to claim 15 wherein said first and second toning units are integrally formed with a common wall between said first and second toning stations and said third and fourth toning stations, respectively.

17. Image-forming apparatus according to claim 15 wherein said first and second toning units are each asymmetrical but in which said units are mirror images of each other.

18. Image-forming apparatus according to claim 15 wherein each of said toning stations includes mixing means below its applicator and includes sidewalls which are generally parallel with each other and generally vertically oriented.

19. A toning unit for applying two different toners selectively to electrostatic images carried on an image surface of a drum-shaped image member, which image member includes cylindrical positioning surfaces associated with opposite ends of the image surface, said toning unit including:

first and second toning stations for applying toner to an electrostatic image, each of said toning stations including an elongated applicator having opposite ends and a toner-bearing surface having a desired positional relationship with respect to said image surface, a pair of spacing means mounted coaxially with each applicator, one at each of its opposite ends for contacting said positioning surface to position said applicator precisely with respect to the image surface, said unit having only four spacing means, said toning stations being fixed with respect to each other with the axes of rotation of the applicators being parallel with each other, and said toning unit being urgable as a unit into operative relationship with the image member with only the four spacing means of said unit in contact with the positioning surfaces accurately positioning the applicators with respect to the image surface.

* * * * *